US010254097B2

(12) United States Patent
Lyman et al.

(10) Patent No.: US 10,254,097 B2
(45) Date of Patent: Apr. 9, 2019

(54) SHAPE MEMORY ALLOY DISC VENT COVER RELEASE

(71) Applicant: Raytheon Company, Waltham, MA (US)

(72) Inventors: Ward D. Lyman, Tucson, AZ (US); Frederick B. Koehler, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 438 days.

(21) Appl. No.: 14/687,693

(22) Filed: Apr. 15, 2015

(65) Prior Publication Data

US 2016/0305754 A1 Oct. 20, 2016

(51) Int. Cl.
*F42B 39/14* (2006.01)
*F42B 39/20* (2006.01)

(52) U.S. Cl.
CPC ..... *F42B 39/14* (2013.01); *F42B 39/20* (2013.01)

(58) Field of Classification Search
CPC ..... F42B 39/14; F42B 39/20
USPC ..... 137/68.19–68.27
See application file for complete search history.

(56) References Cited

U.S. PATENT DOCUMENTS 892,625 A 7/1908 Sebring
2,177,059 A 10/1939 Derby
2,178,929 A 11/1939 Cline
3,467,120 A * 9/1969 Hill ..... F16K 17/162 137/68.21
3,520,455 A 7/1970 Smith
3,672,715 A 6/1972 Carson
(Continued)

FOREIGN PATENT DOCUMENTS

GB 1283941 8/1972
GB 2253030 8/1992
(Continued)

OTHER PUBLICATIONS

International Search Report and Written Opinion dated Mar. 11, 2010 in connection with International Patent Application No. PCT/US2009/06471, 6 pgs.
(Continued)

*Primary Examiner* — Kevin Lee
*Assistant Examiner* — P. Macade Nichols

(57) ABSTRACT

A release mechanism includes a frame with an interior. The release mechanism also includes a prestrained element coupled to the interior of the frame. The prestrained element creates a seal with the frame. The prestrained element is notched in one or more regions. The prestrained element is configured to fracture when heated to a predetermined temperature allowing the interior to open. The fracture is based on the notched regions of the prestrained element such that separation initiates within the notched regions. The remaining regions of the prestrained element unfractured. The shape memory alloy element can include one or more of a nickel-titanium alloy, a titanium-nickel alloy, a copper-zinc-aluminum alloy, a copper aluminum nickel alloy, and a nickel titanium hafnium alloy. Heating of the shape memory alloy element causes a stress in the shape memory alloy that causes fracturing of the prestrained alloy when sufficient heating has been achieved.

20 Claims, 8 Drawing Sheets

(56) References Cited

U.S. PATENT DOCUMENTS

| | | | | |
|---|---|---|---|---|
| 3,777,772 | A * | 12/1973 | Arnold | B60R 21/268 137/68.13 |
| 3,779,004 | A | 12/1973 | Gloeckler | |
| 4,071,271 | A | 1/1978 | Bourrie et al. | |
| 4,161,804 | A | 7/1979 | D'Hooge et al. | |
| 4,169,976 | A | 10/1979 | Cirri | |
| 4,489,964 | A | 12/1984 | Kipp et al. | |
| 4,498,368 | A | 2/1985 | Doane | |
| 4,505,180 | A * | 3/1985 | Hinrichs | F02K 9/38 137/68.21 |
| 4,568,044 | A | 2/1986 | DiTommaso et al. | |
| 4,647,090 | A | 3/1987 | Jones | |
| 4,716,731 | A | 1/1988 | Sakai et al. | |
| 4,945,727 | A | 8/1990 | Whitehead et al. | |
| 5,022,690 | A | 6/1991 | Coltrin et al. | |
| 5,061,914 | A | 10/1991 | Busch et al. | |
| 5,105,178 | A | 4/1992 | Krumme | |
| 5,119,555 | A | 6/1992 | Johnson | |
| 5,129,753 | A | 7/1992 | Wesley et al. | |
| 5,160,233 | A | 11/1992 | McKinnis | |
| 5,245,738 | A | 9/1993 | Johnson | |
| 5,248,233 | A | 9/1993 | Webster | |
| 5,364,046 | A | 11/1994 | Dobbs et al. | |
| 5,630,308 | A | 5/1997 | Guckenberger | |
| 5,916,466 | A | 6/1999 | Dixon | |
| 5,924,696 | A | 7/1999 | Frazier | |
| 6,126,115 | A | 10/2000 | Carrier et al. | |
| 6,126,371 | A | 10/2000 | McCloskey | |
| 6,571,715 | B1 | 6/2003 | Bennett et al. | |
| 6,622,971 | B1 | 9/2003 | Robertson | |
| 6,869,044 | B2 | 3/2005 | Geswender et al. | |
| 6,869,666 | B2 | 3/2005 | Deeb et al. | |
| 7,219,687 | B2 | 5/2007 | Vasquez et al. | |
| 7,241,669 | B2 | 7/2007 | Swenson et al. | |
| 7,396,182 | B2 | 7/2008 | Retat et al. | |
| 7,829,830 | B1 | 11/2010 | Rogers | |
| 7,909,288 | B2 | 3/2011 | Anghileri | |
| 8,186,260 | B2 | 5/2012 | Martin et al. | |
| 8,203,108 | B2 | 6/2012 | Geswender et al. | |
| 8,258,447 | B2 | 9/2012 | Blake et al. | |
| 8,312,813 | B2 | 11/2012 | McDermott et al. | |
| 8,569,670 | B1 | 10/2013 | Carlucci et al. | |
| 8,686,329 | B2 | 4/2014 | Barry et al. | |
| 8,754,352 | B2 | 6/2014 | Pietrzak et al. | |
| 8,895,908 | B2 | 11/2014 | Barry et al. | |
| 2002/0062547 | A1 | 5/2002 | Chiodo et al. | |
| 2003/0128491 | A1 | 7/2003 | Bueno Ruiz et al. | |
| 2003/0145801 | A1 | 8/2003 | DeBien | |
| 2004/0200435 | A1 | 10/2004 | DeBien | |
| 2005/0042805 | A1 | 2/2005 | Swenson et al. | |
| 2005/0136270 | A1 | 6/2005 | Besnoin et al. | |
| 2005/0009235 | A1 | 9/2005 | Swenson et al. | |
| 2005/0205576 | A1 | 9/2005 | Bednara et al. | |
| 2006/0088366 | A1 | 4/2006 | Retat et al. | |
| 2006/0213455 | A1 | 9/2006 | DeBien | |
| 2007/0028964 | A1 | 2/2007 | Vasquez et al. | |
| 2008/0034750 | A1 | 2/2008 | Gao et al. | |
| 2008/0273821 | A1 | 11/2008 | Doll | |
| 2010/0032515 | A1 | 2/2010 | Geswender et al. | |
| 2010/0097223 | A1 | 4/2010 | Kruest et al. | |
| 2010/0139264 | A1 | 6/2010 | Lyman et al. | |
| 2010/0264254 | A1 | 10/2010 | Rogers | |
| 2011/0073709 | A1 | 3/2011 | Blake | |
| 2011/0155265 | A1 | 6/2011 | Kikuchi et al. | |
| 2011/0232278 | A1 | 9/2011 | Lyman et al. | |
| 2011/0232562 | A1 | 9/2011 | Koehler et al. | |
| 2011/0234362 | A1 | 9/2011 | Koehler et al. | |
| 2012/0074256 | A1 | 3/2012 | Pietrzak et al. | |
| 2012/0103175 | A1 | 5/2012 | Martin et al. | |
| 2012/0119014 | A1 | 5/2012 | Barry et al. | |
| 2012/0181294 | A1 | 7/2012 | Sunday et al. | |
| 2013/0306796 | A1 | 11/2013 | Alazraki | |
| 2014/0102090 | A1 | 4/2014 | Koehler et al. | |
| 2014/0158830 | A1 | 6/2014 | Rossettini et al. | |
| 2014/0312160 | A1 | 10/2014 | Blake et al. | |
| 2015/0084353 | A1 | 3/2015 | Koehler et al. | |

FOREIGN PATENT DOCUMENTS

| | | |
|---|---|---|
| GB | 2320277 | 6/1998 |
| JP | 06087085 | 3/1994 |
| JP | 2006316830 A | 11/2006 |
| WO | WO 99/18312 | 4/1999 |
| WO | WO 99/60235 | 11/1999 |
| WO | WO 2008/127806 A1 | 10/2008 |
| WO | WO 2010/068266 A1 | 6/2010 |
| WO | WO 2011127369 | 10/2011 |
| WO | WO 2012170659 | 12/2012 |

OTHER PUBLICATIONS

Roberto Gardi, "A non-pyrotechnic multipoint release system for deployable telescope, activated by shape memory alloy wires", Oct. 4-8, 2004, 2 pages.

Office Action dated May 10, 2011 in connection with U.S. Appl. No. 12/332,004, 7 pgs.

International Search Report and Written Opinion dated Nov. 14, 2013 in connection with International Patent Application No. PCT/US2013/045571, 13 pgs.

Extended European Search Report dated Sep. 15, 2015 in connection with European Patent Application No. 13829230.5, 6 pgs.

U.S. Patent Application "Passive Safety Mechanism Utilizing Self-Fracturing Shape Memory Material", U.S. Appl. No. 13/586,188, filed Aug. 15, 2012, 24 pgs.

International Search Report and Written Opinion of the International Searching Authority dated May 30, 2016 in connection with International Application No. PCT/US2016/017682, 14 pages.

* cited by examiner

SHAPE MEMORY ALLOY DISC VENT COVER RELEASE

TECHNICAL FIELD

This disclosure is generally directed to safety mechanisms. More specifically, this disclosure is directed to passive and active opening mechanisms that are integral to a vessel or manifold and utilizes a self-fracturing shape memory material.

BACKGROUND OF THE DISCLOSURE

In various circumstances, people or equipment need to be protected from adverse situations that can arise in high-temperature environments. For example, air-to-air missiles and other ordnance are routinely stored or transported in containers. Unfortunately, a container carrying ordnance can sometimes be subjected to rising temperatures, which can lead to what are known as "slow cook-off" events and "fast cook-off" events. Additionally, excessive heating can cause ignition prior to pressurization when dealing with certain materials such as hydrogen fuel cells or liquid fuel transpot.

A "slow cook-off" event occurs when ordnance is heated slowly until explosive material in the ordnance ignites. Because a casing that surrounds the explosive material is heated slowly, the casing can actually retain much of its original strength, even though the casing reaches an elevated temperature. As a result, ignition of the explosive material can actually result in detonation of the ordnance. This is clearly undesirable, particularly when the ordnance is located on a naval vessel, in a building, or in another location where people can be harmed or killed and equipment can be damaged from the resulting detonation.

A "fast cook-off" event occurs when ordnance is heated rapidly. This can still result in ignition of the explosive material, but it is less likely to result in detonation of the ordnance. Still, ignition of the explosive material is undesirable and can cause harm to people and damage to equipment.

SUMMARY OF THE DISCLOSURE

To address one or more of the above-deficiencies of the prior art, one embodiment described in this disclosure provides a passive safety mechanism utilizing a self-fracturing shape memory material.

In a first embodiment, a release mechanism includes a frame with an interior. The release mechanism also includes a prestrained element coupled to the interior of the frame. The prestrained element creates a seal with the frame. The prestrained element is notched in one or more regions. The prestrained element is configured to fracture when heated to a predetermined temperature allowing the interior to open. The fracture is based on the notched regions of the prestrained element such that separation initiates within the notched regions. The remaining regions of the prestrained element are unfractured. The prestrained element can be a shape memory alloy element. The shape memory alloy element can include one or more of a nickel-titanium alloy, a titanium-nickel alloy, a copper-zinc-aluminum alloy, a copper aluminum nickel alloy, and a nickel titanium hafnium alloy. Heating of the shape memory alloy element causes a stress in the shape memory alloy that causes fracturing of the shape memory alloy when sufficient heating has been achieved. The prestrained element comprises a weakened portion wherein the prestrained element preferentially fractures. The prestrained element comprises one or more indentations adjacent to the weakened portion providing a reduced cross section to the weakened portion.

In a second embodiment, a system includes a structure and a venting disc. The structure is configured to retain a material. The venting disc is configured to contain a material within the structure. The venting disc includes a frame with an interior and a prestrained element coupled to the interior of the frame. The prestrained element fractures when heated to a predetermined temperature allowing the interior to open.

In a third embodiment, a method includes exposing a release mechanism to an ambient environment, wherein the release mechanism comprises a frame and a shape memory material, wherein the shape memory material fills an interior of the frame. The method also includes fracturing the shape memory material when exposed to an elevated temperature to allow the interior of the frame to open.

Although specific advantages have been enumerated above, various embodiments may include some, none, or all of the enumerated advantages. Additionally, other technical advantages may become readily apparent to one of ordinary skill in the art after review of the following figures and description.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

It should be understood at the outset that, although example embodiments are illustrated below, the present invention can be implemented using any number of techniques, whether currently known or not. The present invention should in no way be limited to the example implementations, drawings, and techniques illustrated below. Additionally, the drawings are not necessarily drawn to scale.

FIGS. 1A through 9, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

Figure 1A:
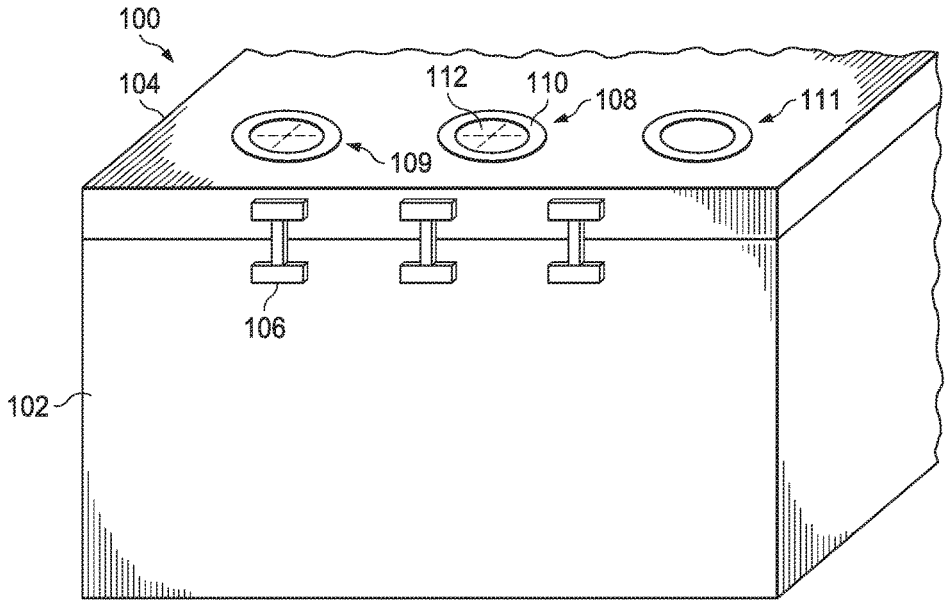
FIG. 1A illustrates an example container having a passive safety mechanism utilizing a self-fracturing shape memory material in accordance with this disclosure.

FIG. 1A illustrates an example container 100 having a passive safety mechanism utilizing a self-fracturing shape memory material in accordance with this disclosure. As described above, the container 100 can be used to store or transport air-to-air missiles and other ordnance. During a slow or fast cook-off event, the ordnance in the container 100 might heat up, ignite, and possibly even detonate. However, as described below, the container 100 includes a mechanism that can vent the container 100 when conditions arise that might lead to a slow cook-off event or a fast cook-off event. This helps to prevent over-pressurization of the container 100.

As shown in FIG. 1A, the container 100 includes a main body 102 and a lid 104. The main body 102 represents the portion of the container 100 that defines an interior compartment used to hold cargo. The lid 104 represents the portion of the container 100 that is raised or removed to provide access to the interior compartment of the container 100 and that is lowered or replaced to cover the main body 102 of the container 100.

The container 100 can be used to store or transport any suitable cargo. The cargo could represent military ordnance or any other products, objects, materials, or other items being stored or transported in the container 100. The container 100 could have any suitable size, shape, and dimensions suitable for storing or transporting the desired cargo. The container 100 could also be formed from any suitable material(s), such as hardened plastic or metal.

In this example, the lid 104 is secured to the main body 102 of the container 100 using one or more latches 106. The latches 106 could be located on one side of the container 100 or on multiple sides of the container 100. When used on all sides of the container 100, the latches 106 could allow the lid 104 to be completely removed from the main body 102. When used on less than all sides of the container 100 (such as on a single side of the container 100), the lid 104 could be connected to the main body 102 by hinges or other mechanisms that allow the lid 104 to pivot on an edge of the main body 102.

In this example, the container 100 includes venting discs 108, 109, and 111. The venting disc 108 can be a thermally activated burst disc or pressure activated. The venting disc 108 can open or burst to allow air or gas to pass through. The venting disc 108 can burst in reaction to thermal changes. The venting disc 108 can include a frame 110 and a prestrained element 112. Venting discs 109 and 111 can be similar or different from venting disc 108. For example, in on embodiment, venting disc 109 is etched in a cross pattern similar to venting disc 108, while venting disc 111 may be etched in a circular patter around the edge near the frame unlike venting disc 108. In other words, venting discs 108 and 109 may self-fracture and stay attached to a frame, while venting disc 111 may fully separate from its frame.

At least one of the venting discs 108 uses a self-fracturing shape memory material. When subjected to an elevated temperature, the shape memory material can fracture, allowing the prestrained element 112 to partially separate from itself or the frame 108 along one or more strained areas. This vents the container 100 and helps to prevent over-pressurization of the cargo inside the container 100. In this disclosure, the phrase "elevated temperature" refers to a temperature at or above which a shape memory material member fractures. Fracturing as used herein may be defined as parts of the material separating from itself. Fracturing as used herein may also be referred to as breaking or separating.

The prestrained element 112 can be formed of a shape memory material. In the original shape, the shape memory alloy is in an austenite phase, which has a cubic crystal structure. When cooled to a low temperature, the shape memory alloy in the austenite phase transitions back to the martensite phase. Unlike other metals, this transition between the phases (austenite phase to martensite phase) eversible and repeatable. It should be appreciated that a large amount of energy is stored in the deformed martensite phase, and this energy used by the shape memory alloy to return to its original shape can also be used to separate the shape memory alloy. The shape memory material can be formed from any suitable material(s), such as a shape memory alloy. As particular examples, the shape memory material could be formed from a nickel-titanium alloy (such as Nitinol), a titanium-nickel alloy, a copper-zinc-aluminum alloy, a copper-aluminum-nickel alloy, or a nickel-titanium-hafnium alloy. The shape memory material can also be formed in any suitable manner.

In addition, the shape memory material can have any suitable shape, such as a circular structure having one or more notches, a semicircular structure, and the like. In particular embodiments, the shape memory material can be designed to fracture at a desired temperature, such as a temperature between about 35° C. and about 150° C. For instance, the composition, thickness, or notch size of the material or the amount of stretching used to fabricate the material could be varied to alter the temperature at which the material fractures.

The selection of the shape memory alloy, its specific composition to set the Austenite finish (Af) and Martensite finish (Mf) temperatures, thickness, material geometry, prestrain direction and prestrain amount determine the performance of the prestrained element 112. For example, the thickness of the sheet can be changed to optimize strain levels. Thinner sheet will decrease strain given a fixed forced displacement.

Additional details regarding the use of a shape memory material in a venting disc 108 are provided below. In some embodiments, the venting disc 108 can be retrofitted onto existing containers used by the United States military or other organizations. The venting disc 108 could be designed as a drop-in or near-drop-in replacement for different mechanisms, enabling rapid deployment of the venting disc 108.

One or more embodiments recognizes and takes into account a desire to replace pyro valves, where with active heating, open a pressurized container or fuel path to system. It is also desirable to have dual protection systems in either over-pressure or over-temperature situations. It is also desirable to have an active cover release for lens cover. An active cover release initially prevents environment from getting inside and, when desired, a prestrained element of this disclosure exposes optics.

Although FIG. 1A illustrates one example of a container 100 having a passive safety mechanism utilizing a self-fracturing shape memory material, various changes may be made to FIG. 1A. For example, the container 100 could include any number of venting discs 108 on any number of sides of the container 100.

Figure 1B:
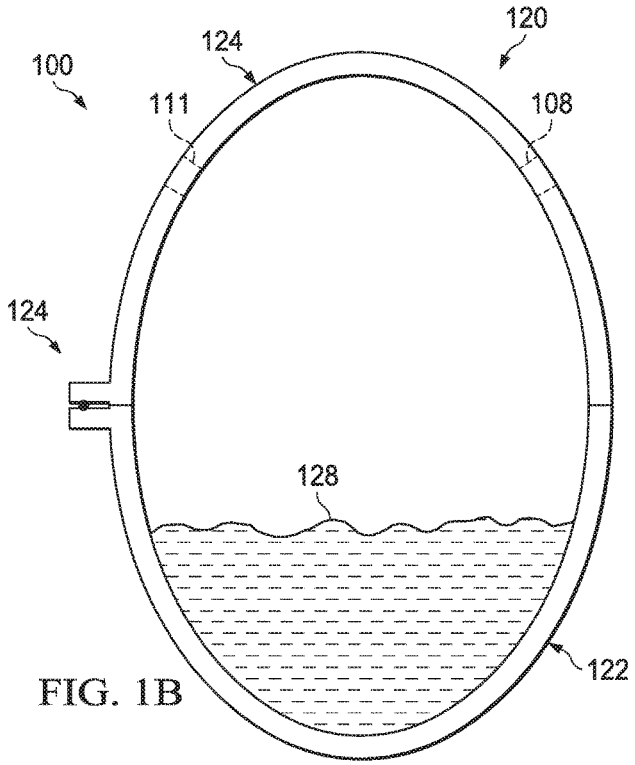
FIG. 1B illustrates another example structure having a passive safety mechanism utilizing a self-fracturing shape memory material in accordance with this disclosure.

FIG. 1B illustrates another example structure having a passive safety mechanism utilizing a self-fracturing shape memory material in accordance with this disclosure. As shown in FIG. 1B, the boiler 120 generally includes a boiler base 122 and a boiler prestrained element 124. The boiler base 122 generally represents the portion of the boiler 120 that receives a liquid or other material 128 to be heated. The boiler prestrained element 124 generally represents the portion of the boiler 120 that covers the base 122. The boiler base 122 and boiler prestrained element 124 can be sealed together during operation to prevent the material 128 from escaping along the junction of the base 122 and the prestrained element 124. The prestrained element 124 is coupled to the base 122 using at least one hinge 130.

In this example, one or more venting discs 108 and 111 can also be used to vent the boiler 120. However, one or more venting discs 108 could be used in other ways in the boiler 120. One or multiple venting discs 108 could be placed in any suitable location(s).

Although FIG. 1B illustrates another example of a structure having a passive safety mechanism utilizing a self-fracturing shape memory material, various changes may be made to FIG. 1B. For example, the boiler 120 could include any number of venting discs 108 at any number of locations around the boiler 120.

Note that securing a container or boiler prestrained element represents example ways that a shape memory material in a venting disc 108 can be used to as a safety mechanism (venting the container 100 or boiler 120 at elevated temperatures). The venting disc 108 could find a wide range of uses in both military and non-military applications. As example military uses, the venting disc 108 can be used as a passively-activated mechanism in containers for ordnance and as a release for general non-exploding actuators or other devices. As example non-military uses, many commercial industrial safety mechanisms could use the venting disc 108, such as in devices and systems where a temperature spike can cause over-pressurization. Particular applications can include over-pressure releases for pressure vessels, flammable chemical containment vessels, steam plants, and commercial non-exploding actuators.

Also note that the above has described a prestrained element or vent opening when a prestrained element 112 of the venting disc 108 separates (or fractures) at a target pressure when exposed to an over-pressurization within the container 100 or boiler 120. However, other mechanisms could be used to open a vent, or other structure upon separation of one or more venting discs 108. For example, spring-loaded hinges or other spring-loaded mechanisms or a hydraulic mechanism could be used to open a vent upon separation of the prestrained element 112. In general, any mechanism that can open a prestrained element 112 or other structure upon separation of one or more venting discs 108 could be used. The prestrained element 112 can be defined as a separable element that is configured to fracture or break apart when a certain level of temperature is applied. The prestrained element 112 can be a shape memory alloy or material.

In addition, one or more identification mechanisms could be used to help identify a separated venting disc 108. For example, a venting disc 108 could be connected to a movable flag that changes position when the prestrained element 112 separates, a color-changing device that changes color when the prestrained element 112 separates, or a dye-pack that breaks when the prestrained element 112 separates. In these embodiments, one or more venting discs 108 could be used to secure a prestrained element or vent, while one or more other latches could be used as an identification mechanism. In other embodiments, an identification mechanism could be incorporated into the venting disc 108 themselves. For instance, the venting disc 108 could include a flag, such as on the holder or the retaining pin that becomes visible when the prestrained element 112 separates. Any other suitable identification mechanism(s) could be used here.

Various embodiments of this disclosure recognize and take into account that typical conventional burst disc tolerance is −3% and +6%. For 5,000 psi cryo bottle, the tolerance is 4850-5300 psi. For a shape memory alloy device of this disclosure, the tolerance can be +/−20 degrees Fahrenheit, providing significant improvement on burst pressure tolerance to 4870-5130 psi.

Figure 2:
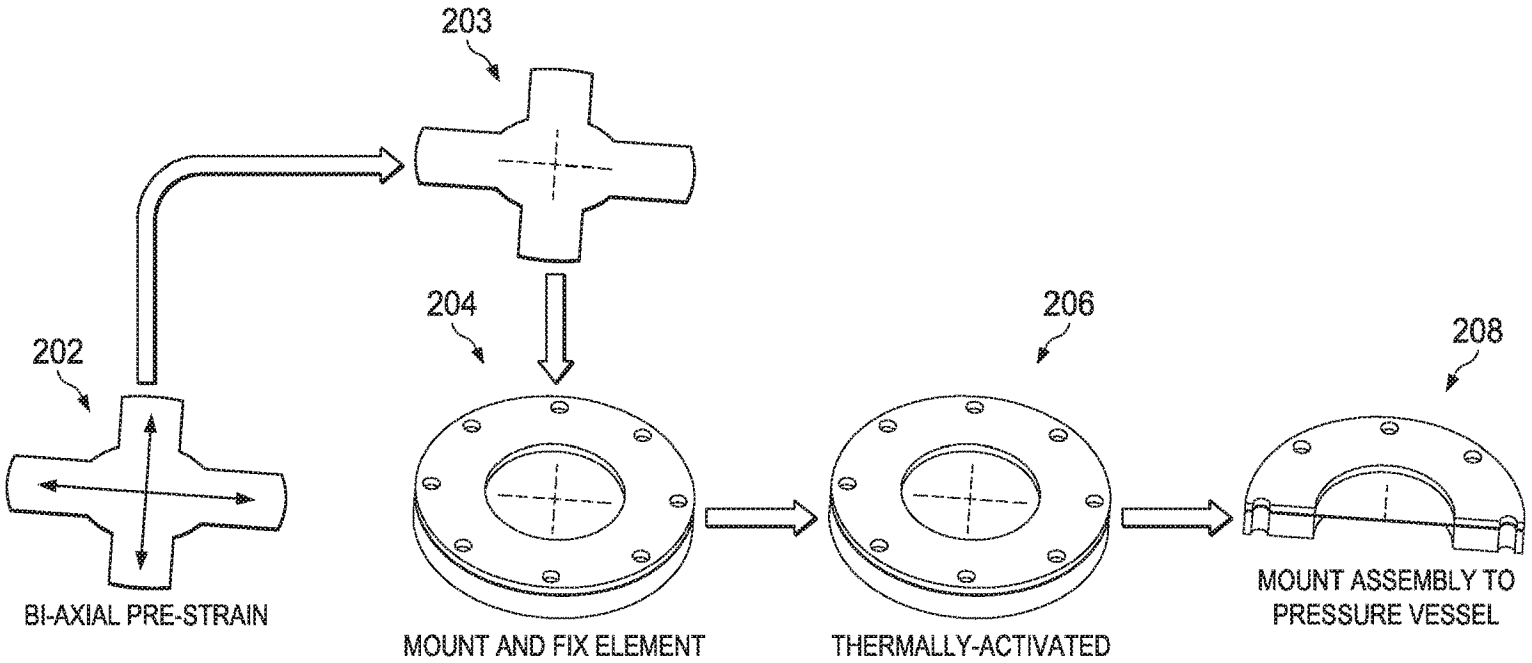
FIG. 2 illustrates a process of forming a venting disc in accordance with this disclosure.

FIG. 2 illustrates a process of forming a venting disc in accordance with this disclosure. As shown in FIG. 2, the venting disc can be one example of venting disc 108 as shown in FIG. 1A. In this example embodiment, the venting disc can be a shape memory alloy (SMA) burst disc. The embodiment of the venting disc illustrated in FIG. 2 is for illustration only. However, venting discs come in a wide variety of configurations, and FIG. 2 does not limit the scope of this disclosure to any particular implementation of a venting disc.

While the SMA material 202 is in the martensite phase, it is strained in two orthogonal directions, either sequentially or at the same time. In other embodiments, the SMA material 202 can be strained in all directions equally, a signal direction, or any other possible combinations of directions. At 203, the center of the bi-axially strained SMA material 202 is scored (i.e., etched or notched) to a predesigned depth and orthogonally to the strained directions. In one embodiment, the scoring, or etching, can be performed mechanically. In other embodiments of this disclosure, the scoring can be performed chemically. The score pattern can have alternate configurations.

In an embodiment, fasteners, fixtures, welding and the like can restrain the extremities of the hi-axially strained region of the SMA material 202. The SMA material 202 can be fastened or the like to a frame 204. The frame 204 can be a single piece, or a combination of multiple pieces restraining the SMA material 202.

The SMA material 202, outside of the bi-axially strained and fastener/fixture or weld regions can then be removed, leaving a disc of SMA material 202 which can be affixed (as part of secondary structure) or integral to a vessel, container, boiler, and the like. When thermally activated, by reaching a specified or predetermined temperature, the SMA material 202 can fracture 206. A cross sectional view 208 shows the frame 204 and the SMA material 202.

In one or more embodiments of FIG. 2, the venting disc can be a pass over-temperature safety venting device. The thermal sensing plus self-separation (fracturing) allows for venting. The venting disc can be co-configured in a dual safety mode also as an over-pressure safety device. In another embodiment, the venting disc can be an actuator. The actuator can be signaled by active heating via a strip heater an induce opening of the disc. The actuator can also replace squibs that open pressure vessels, replace safety valves, and be an external temperature sensing device that triggers a signal to a heater.

Figure 3:
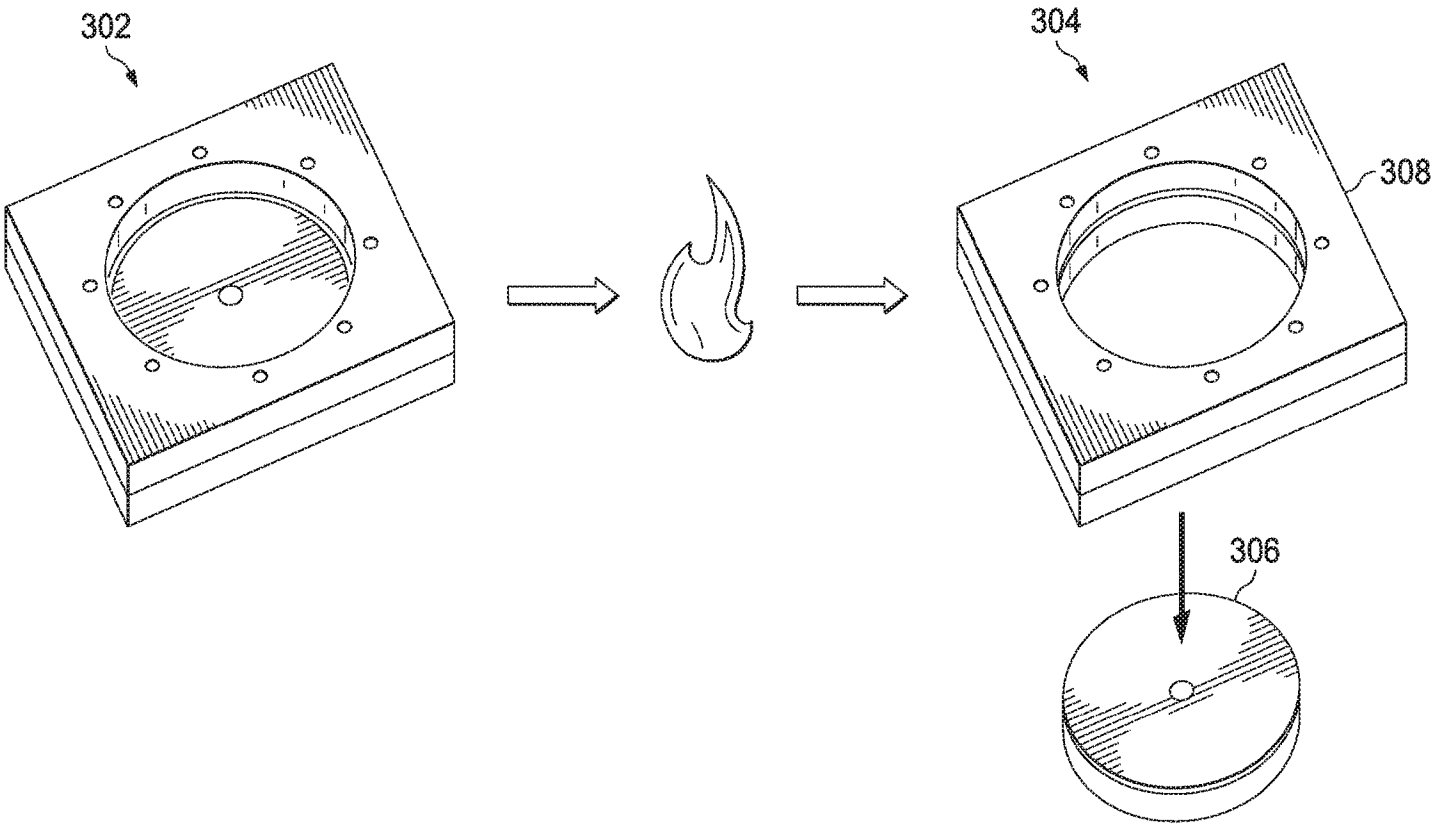
FIG. 3 illustrates an activated venting disc in accordance with this disclosure

FIG. 3 illustrates an activated fully separating venting disc in accordance with this disclosure. As used herein, fully separating can be defined where the SMA not only fractures, but additionally fractures in a way in that part of the SMA is fully separated from another part of the SMA or another object. The embodiment of the activated venting disc illustrated in FIG. 3 is for illustration only. However, activated venting discs come in a wide variety of configurations, and FIG. 3 does not limit the scope of this disclosure to any particular implementation of an activated venting disc.

Illustration 302 shows a fully separating venting disc, such as venting disc 111 as shown FIG. 1A prior to being thermally activated. Inactivated disc 302 can prevent the flow of material such as liquid or gas or protect contents from environment.

Illustration 304 shows a venting disc 306 after being thermally activated. After being activated, venting disc 306 can fully separate from frame 308. Once separated, venting disc can fall away from frame 308. After venting disc 306 is removed from frame 308, frame 308 allows material to pass.

In one or more embodiments of FIG. 3, the venting disc can be an actuator. The actuator can signal active heating via a strip heater for actuation. In another embodiment, the disc can be intended for applications where a sealed structure is desirable at one point in time and then opened at another point in time. The cover or barrier to the sealed structure can be removed by a venting disc, in for example, optic covers, antenna covers, gas/fluid exhaust systems, and gas/fluid intake systems.

Figure 4:
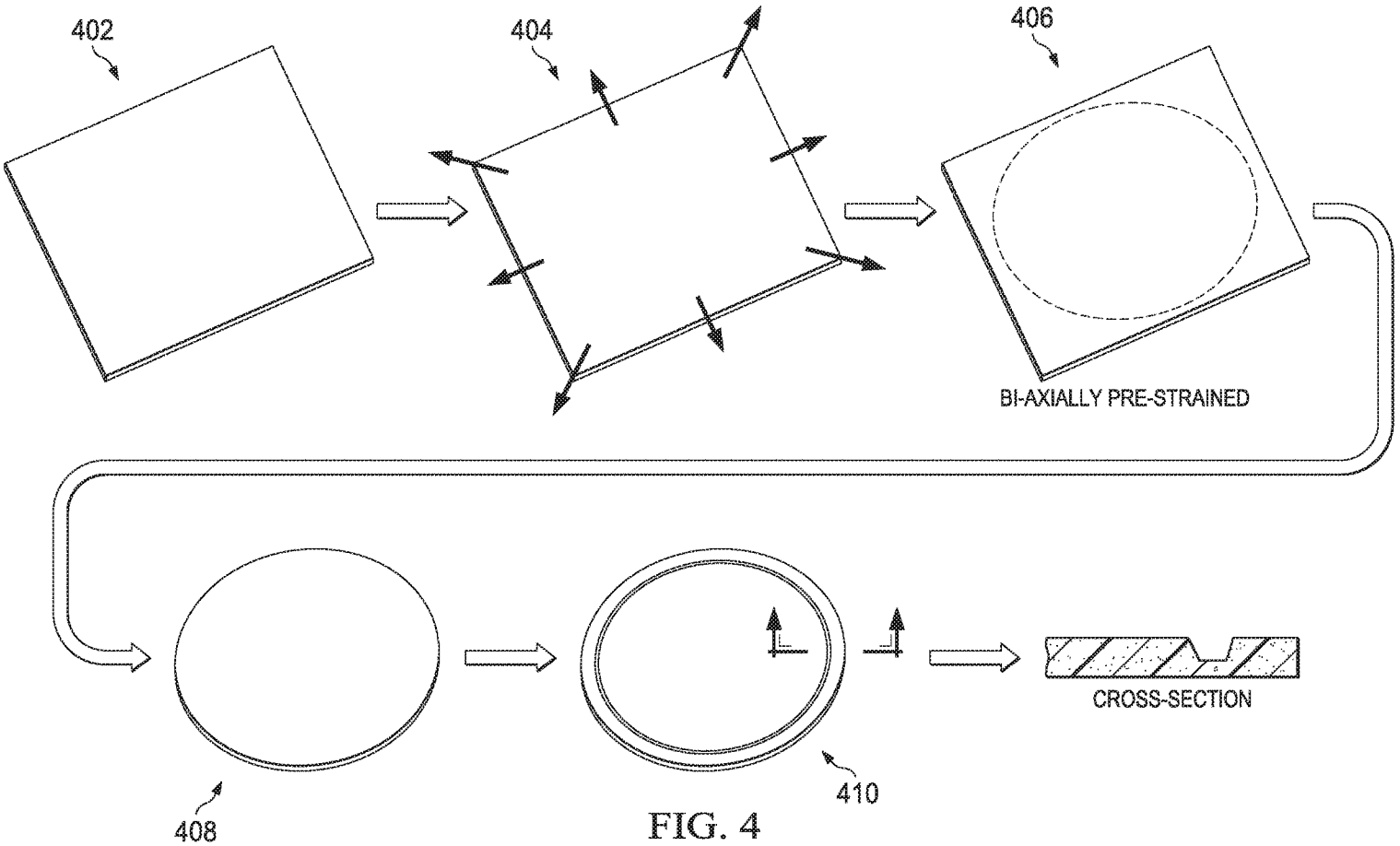
FIG. 4 illustrates a prestrained element for a venting disc during different steps in a manufacturing process in accordance with this disclosure.

FIG. 4 illustrates a prestrained element for a venting disc during different steps in a manufacturing process in accordance with this disclosure. The embodiment of the prestrained element illustrated in FIG. 4 is for illustration only. However, the prestrained element comes in a wide variety of configurations, and FIG. 4 does not limit the scope of this disclosure to any particular implementation of the prestrained element.

In a manufacturing process, the prestrained element may begin as a SMA sheet 402. The SMA sheet can be cut from a roll of SMA. The process strains the SMA sheet 402 into a pre-strained sheet 404. The pre-strained sheet 404 can be strained bi-axially. In other embodiments, the pre-strained sheet 404 can be strained omnidirectional, another direction, or combination of directions or possible unidirectional.

The pre-strained sheet 402 can be section marked 404 and sectioned into a final pattern to be used with a frame. The sectioned sheet can be cut into prestrained element 408. The prestrained element can be etched into a notched prestrained element 410. The notched prestrained element is used to increase the likelihood the prestrained element fractures in specific areas that are etched.

Figure 5:
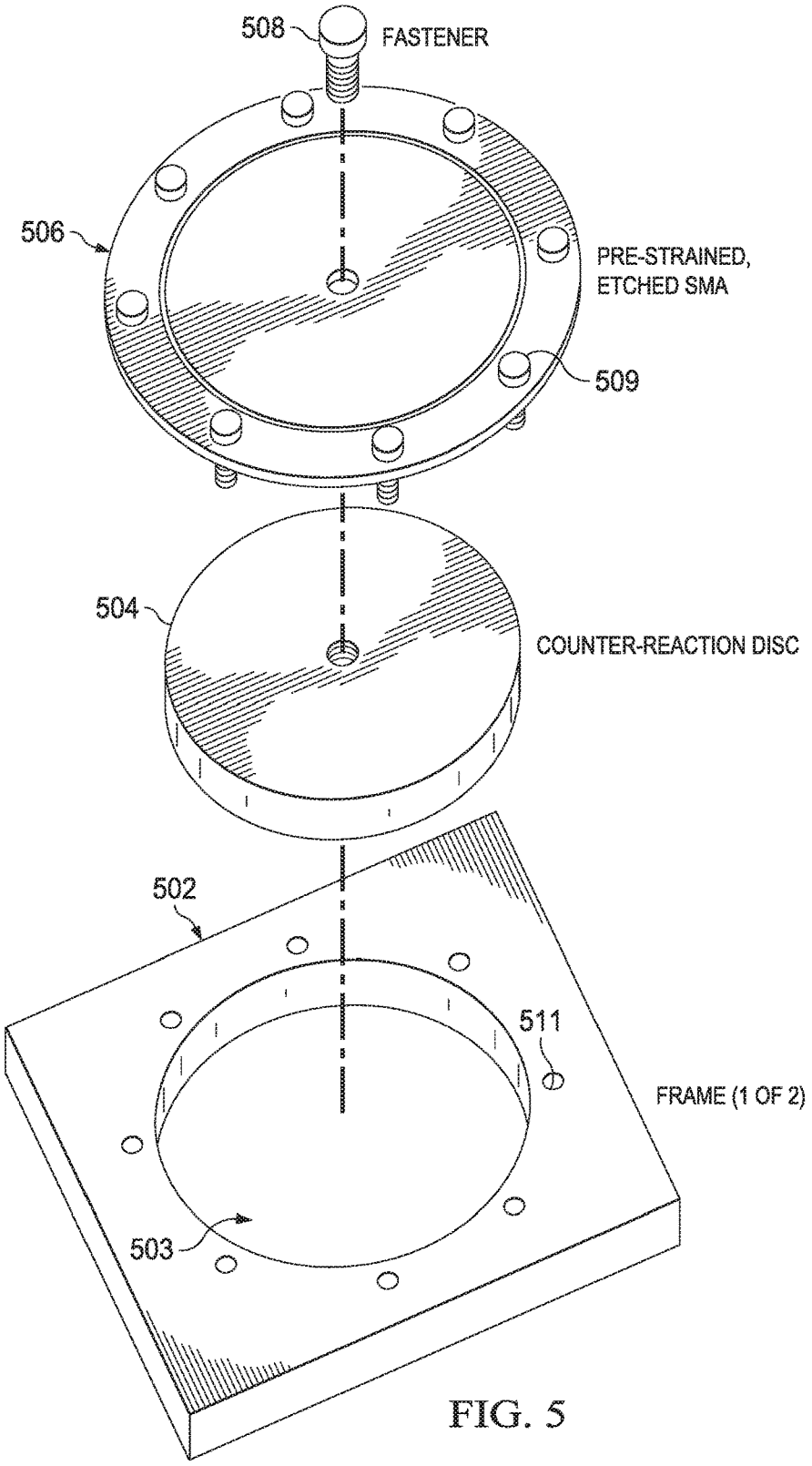
FIG. 5 illustrates components of a venting disc in accordance with this disclosure.

FIG. 5 illustrates components of a venting disc in accordance with this disclosure. The embodiment of the components illustrated in FIG. 5 is for illustration only. However, the components come in a wide variety of configurations, and FIG. 5 does not limit the scope of this disclosure to any particular implementation of the components.

In FIG. 5, frame 502 includes an interior 503. The interior 503 can be in an open or closed stated. In a closed state, the interior 503 does not allow for material, such as gas or liquid, to pass through. In an open state, the interior 503 allows gas or liquid to pass through.

Frame 502 may be configured to fit a counter-reaction disc 504. Counter-reaction disc 504 is configured to counter the forces of the SMA when thermally activated. The counter-reaction disc 504 is configured to couple to a prestrained element 506, formed as described in FIG. 4, through fastener 508. The combination of the counter-reaction disc 504, fastener 508 and fasteners 509 allows the prestrained element 508 to generate constrained stresses during thermal activation. Fastener 508 can be defined as a connecting or joining member that fixes a portion of prestrained element 506 to counter-reaction disc 504. Frame 502 may be connected to prestrained element 506 through fasteners 509. Fasteners 509 may be placed around the edge of prestrained element 506 in holes 511.

The prestrained element 506 includes a notched section, referred herein to as an etched or scored section. The notched section represents a portion of the prestrained element 506 having a smaller width than the other portions of the prestrained element 506, so the prestrained element 506 is weaker in the notched section. The notched section therefore represents the area where the prestrained element 506 is likely to fracture when the shape memory material is heated. The prestrained element 506 can have any suitable notch(es) in the notched section. In this example, the notches are circular, although the notches could have any other suitable shape(s) (such as triangular).

The fastener can be referred to as an anchor. The fastener 508 is connected to the prestrained element 506 and holds the prestrained element 506 to counteraction disc. The fastener 508 also help to keep the ends of the prestrained element 506 from moving significantly towards each other when the prestrained element 506 is heated, creating stress in the prestrained element 506 and eventually causing the prestrained element 506 to fracture.

Figure 6:
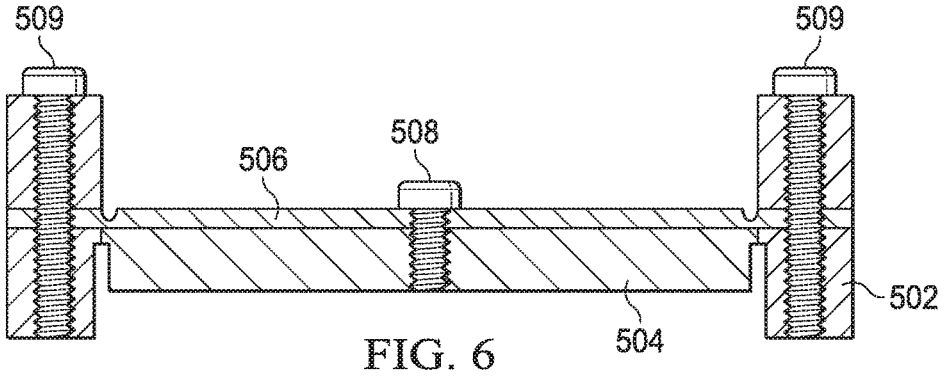
FIG. 6 illustrates cross-sectional view of a venting disc in accordance with this disclosure.

FIG. 6 illustrates cross-sectional view of a venting disc in accordance with this disclosure. The embodiment of the venting disc illustrated in FIG. 6 is for illustration only. However, the venting disc comes in a wide variety of configurations, and FIG. 6 does not limit the scope of this disclosure to any particular implementation of the venting disc.

The cross-sectional view of the venting disc in FIG. 6 can be a cross-sectional view of the venting disc as shown in FIG. 5. The venting disc includes a frame 502, counter-reaction disc 504, prestrained element 506, and fastener 508 and fasteners 509.

Figure 7:
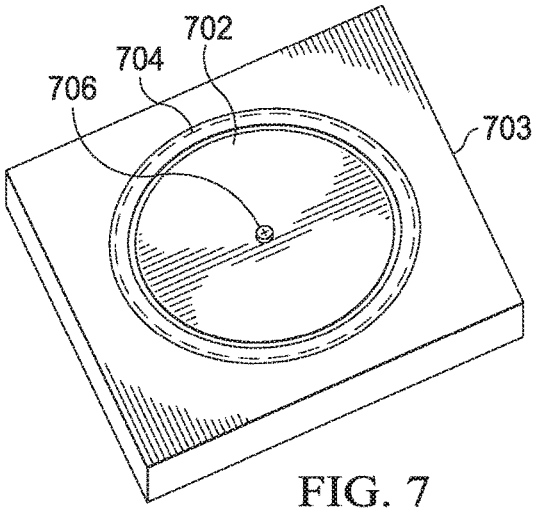
FIG. 7 illustrates a prestrained element welded to a counter-reaction disc in accordance with this disclosure.

FIG. 7 illustrates a prestrained element welded to a counter-reaction disc in accordance with this disclosure. The embodiment of the venting disc illustrated in FIG. 7 is for illustration only. However, the venting disc comes in a wide variety of configurations, and FIG. 7 does not limit the scope of this disclosure to any particular implementation of the venting disc.

In FIG. 7, the prestrained element 702 can be laser welded at ring 704 and fastener 706 to frame 703. Other processes, such as an electronic beam, can weld the prestrained element 702. A circumference of SMA sheet (prestrained element 702) to frame 703. In other embodiments, prestrained element 702 can be welded to a counter-reaction disc. During the welding process, a copper chill can be used to minimize overheating/activating of the SMA material.

Figure 8:
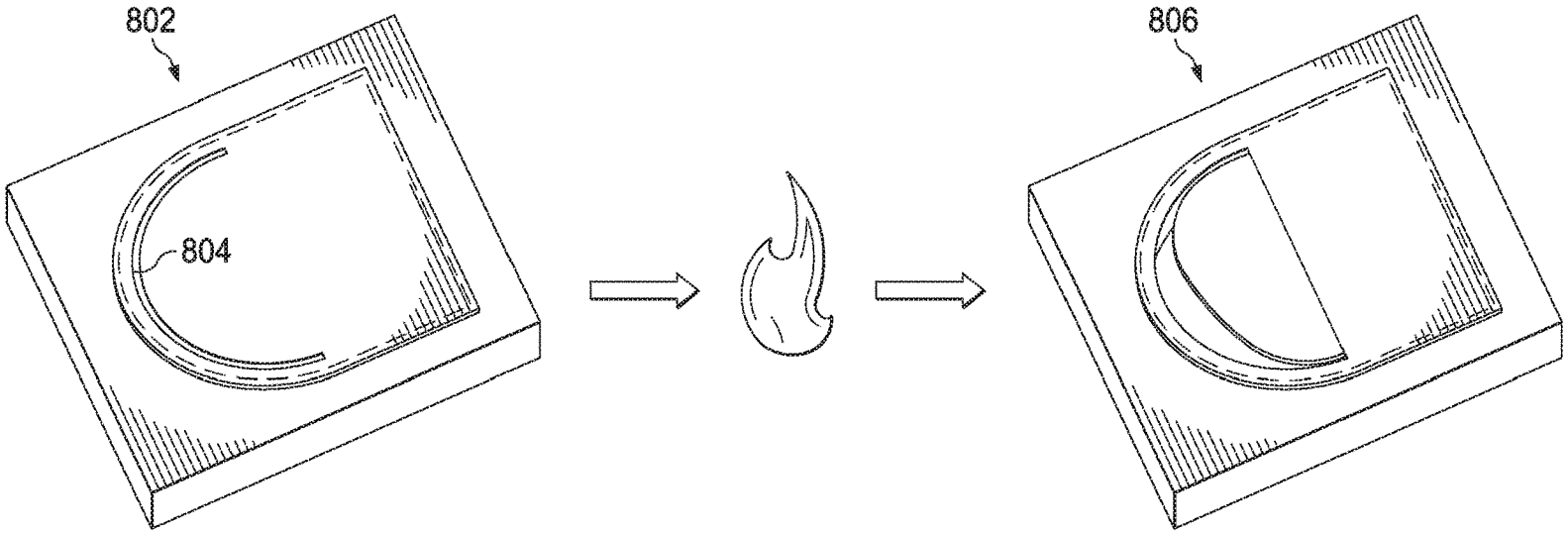
FIG. 8 illustrates a venting disc with a semicircular etching in accordance in accordance with this disclosure.

FIG. 8 illustrates a venting disc with a semicircular etching in accordance in accordance with this disclosure. The embodiment of the venting disc illustrated in FIG. 8 is for illustration only. However, the venting disc comes in a wide variety of configurations, and FIG. 8 does not limit the scope of this disclosure to any particular implementation of the venting disc.

In FIG. 8, the venting disc 802 includes a semicircular etch 804. Venting disc 802 is in an inactive state. Venting disc 806 is in an active state. Venting disc 806 shows fracturing of the semicircular etch 804.

Figure 9:
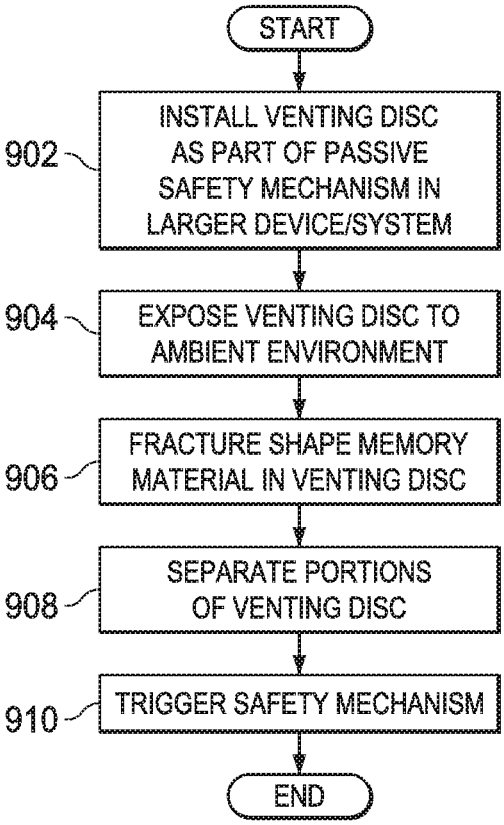
FIG. 9 illustrates an example method for operating a passive safety mechanism utilizing a self-fracturing shape memory material in accordance with this disclosure.

FIG. 9 illustrates an example method 900 for operating a passive safety mechanism utilizing a self-fracturing shape memory material in accordance with this disclosure. As shown in FIG. 9, a vent is installed as part of a passive safety mechanism in a larger device or system at step 902. This could include, for example, a user installing one or more venting discs 108 as part of a container 100. As another example, this could include a user installing one or more venting discs 108 as part of a boiler 120. The venting disc 108 is exposed to the ambient environment at step 904. This could include, for example, exposing the venting disc 108 to various environments as the container 100 is moved to one or more locations. This could also include exposing the venting disc 108 to an environment around the boiler 120.

Eventually, the venting disc could be exposed to an elevated temperature, and a shape memory material in the venting disc fractures at step 906. This could include, for example, the shape memory material 112 fracturing when the temperature in the ambient environment reaches an elevated level, such as between about 35° C. to about 150° C. The temperature at which the shape memory material 112 breaks could be based on various factors, such as the composition of the material 112, the size of the notches in the material 112, the thickness of the material 112, and the way in which the material 112 was fabricated. The shape memory material 112 could fracture at its notched (i.e., etched) section.

When the shape memory material member fractures, multiple portions of the venting disc 108 separate from each another at step 908. The separation of the venting disc 108 portions triggers a safety mechanism at step 910. This could include, for example, the prestrained element of the venting disc separating so that the interior of the frame of the venting disc is open, venting the interior compartment of the container 100.

In an embodiment, the fracture is based on the notched regions of the prestrained element such that separation initiates within the notched regions. The fracture initially propagates through the notched regions, but termination of the fracture can occur in the notched region or extend into unnotched regions, depending upon device intent. References herein are made to a fracture, however, it is understood that a fracture can be at least one fracture and that other fractures may occur.

Although FIG. 9 illustrates one example of a method 900 for operating a passive safety mechanism utilizing a self-fracturing shape memory material, various changes may be made to FIG. 9. For example, while shown as a series of steps, some steps in FIG. 9 could overlap, occur in parallel, or occur any number of times. As particular examples, venting disc 108 could be installed as part of the passive safety mechanism, and the venting disc 108 could be exposed to multiple environments before the shape memory material 112 fractures It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of have a relationship to or with, or the like. Directional terms such as "upper," "lower," "up," and "down" refer to directions within the figures and do not require any particular directional arrangement of components or directional use of a device.

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

To aid the Patent Office, and any readers of any patent issued on this application in interpreting the claims appended hereto, applicants wish to note that they do not intend any of the appended claims or claim elements to invoke paragraph 6 of 35 U.S.C. Section 112 as it exists on the date of filing hereof unless the words "means fix" or "step for" are explicitly used in the particular claim.

What is claimed is:

1. A release mechanism comprising:

a frame with an interior; and a prestrained element coupled to the frame, the prestrained element filling the interior of the frame, and wherein the prestrained element is notched in one or more regions, wherein the prestrained element is configured to fracture when heated to a predetermined temperature allowing the interior to open, and wherein the fracture is based on the one or more regions of the prestrained element such that separation initiates within the one or more regions.

2. The release mechanism of claim 1, wherein the prestrained element comprises a shape memory alloy element.

3. The release mechanism of claim 2, wherein the shape memory alloy element comprises one or more of: a nickel-titanium alloy, a titanium-nickel alloy, a copper-zinc-aluminum alloy, a copper-aluminum: nickel alloy, and a nickel-titanium-hafnium alloy.

4. The release mechanism of claim 2, wherein heating of the shape memory alloy element causes a stress in the shape memory alloy element that causes fracturing of the shape memory alloy element when sufficient heating has been achieved.

5. The release mechanism of claim 1, wherein the prestrained element is notched in the one or more regions to form a weakened portion where the prestrained element preferentially fractures.

6. The release mechanism of claim 5, wherein the prestrained element is notched in the one or more regions by one or more indentations providing a reduced cross section to the weakened portion.

7. The release mechanism of claim 1, wherein the prestrained element is configured to fracture when pressurized to a predetermined pressure allowing the interior to open.

8. The release mechanism of claim 1, wherein:

the frame is configured to be coupled to or forms a part of a container; and the interior of the frame forms a vent for the container.

9. The release mechanism of claim 1, further comprising:

a counter-reaction disc coupled to the prestrained element by a connecting member, the connecting member configured to cause a center of the prestrained element to be fixed.

10. The release mechanism of claim 1, wherein the prestrained element is not fully separable from the frame.

11. The release mechanism of claim 1, wherein a direction of the prestrained element is one of unidirectional, bidirectional, and omnidirectional.

12. A system comprising:

a structure configured to retain a material; and a venting disc configured to contain the material within the structure, wherein the venting disc comprises:

a frame with an interior;

a prestrained element coupled to the frame and filling the interior of the frame, a counter-reaction disc, and a connecting member configured to mechanically couple the prestrained element to the counter-reaction disc, wherein the prestrained element is configured to fracture when heated to a predetermined temperature allowing the interior to open.

13. The system of claim 12, wherein the prestrained element comprises a shape memory alloy element.

14. The system of claim 13, wherein the shape memory alloy element comprises one or more of: a nickel-titanium alloy, a titanium-nickel alloy, a copper-zinc-aluminum alloy, a copper-aluminum-nickel alloy, and a nickel-titanium-hafnium alloy.

15. The system of claim 13, wherein heating of the shape memory alloy element causes a stress in the shape memory alloy element that causes fracturing of the shape memory alloy element when sufficient heating has been achieved.

16. The system of claim 12, wherein the prestrained element is notched in the one or more regions to form a weakened portion where the prestrained element preferentially fractures.

17. The system of claim 16, wherein the prestrained element is notched in the one or more regions by one or more indentations providing a reduced cross section to the weakened portion.

18. A method comprising:

exposing a release mechanism to an ambient environment, wherein the release mechanism comprises a frame and a prestrained element, wherein the prestrained element fills an interior of the frame; and fracturing the prestrained element when exposed to an elevated temperature to allow the interior of the frame to open.

19. The method of claim 18, further comprising:

triggering a safety mechanism in response to the fracturing of the prestrained element.

20. The method of claim 19, wherein triggering the safety mechanism comprises at least partially opening the prestrained element of the release mechanism to thereby vent an interior compartment within a structure.

* * * * *